United States Patent [19]

Serbent et al.

[11] 4,268,304

[45] May 19, 1981

[54] DIRECT REDUCTION PROCESS IN A ROTARY KILN

[75] Inventors: Harry Serbent, Hanau; Friedrich Rosenstock, Frankfurt am Main; Günter Kötzschke, Bruchköbel, all of Fed. Rep. of Germany

[73] Assignee: Metallgesellschaft Aktiengesellschaft, Frankfurt am Main, Fed. Rep. of Germany

[21] Appl. No.: 58,353

[22] Filed: Jul. 17, 1979

[30] Foreign Application Priority Data

Jul. 20, 1978 [DE] Fed. Rep. of Germany ..... 2831827

[51] Int. Cl.[3] ..... C21B 13/00

[52] U.S. Cl. ..... 75/36; 75/25

[58] Field of Search ..... 75/33, 36, 37, 38, 62

[56] References Cited

U.S. PATENT DOCUMENTS 4,175,949 11/1979 Breznay ..... 75/445 X

*Primary Examiner*—M. J. Andrews

*Attorney, Agent, or Firm*—Sprung, Felfe, Horn, Lynch & Kramer

[57] ABSTRACT

An improved process for the direct reduction of iron oxide-containing materials to form sponge iron which takes place in a rotary kiln by treatment with a solid carbonaceous reducing agent having a high content of volatile combustible constituents is disclosed. The charge is moved through the rotary kiln opposite to the direction of flow of the kiln atmosphere. Oxygen-containing gases are blown at controlled rates through nozzle blocks into the charge disposed over the nozzle blocks in the heating-up zone in that region thereof defined by the occurrence of ignitable particles of the solid reducing agent and ending before the reduction zone. Oxygen-containing gases are blown in at controlled rates through shell tubes into the free kiln space at least in that region. In accordance with the invention, at least a part of the solid carbonaceous reducing agent comprises disintegrated waste rubber. Preferably more than 80% of the solid carbonaceous reducing agent comprises waste rubber.

6 Claims, No Drawings

DIRECT REDUCTION PROCESS IN A ROTARY KILN

BACKGROUND OF THE INVENTION

1. Field of the Invention

This invention relates to a process of directly reducing iron oxide-containing material to produce sponge iron in a rotary kiln by a treatment with solid carbonaceous reducing agents having a high content of volatile combustible constituents, e.g., 25 to 50 weight percent in which the charge is moved through the rotary kiln opposite to the direction of flow of the kiln atmosphere, oxygen-containing gases are blown at controlled rates through nozzle blocks into the charge disposed over nozzle blocks in the heating-up zone in that region thereof which begins with the occurrence of ignitable particles of the solid reducing agents and terminates before the reducing zone, and oxygen-containing gases are blown at a controlled rate through shell tubes into the free kiln space at least in that region, in accordance with copending U.S. patent application Ser. No. 898,256, filed Apr. 20, 1978, now U.S. Pat. No. 4,179,280 assigned to the assignee hereof, the disclosure of which is hereby incorporated herein by reference.

2. Discussion of Prior Art

When it is desired to reduce iron ores in a rotary kiln, the latter is fed with a mixture of ore and reducing agent. That mixture is moved through the kiln in dependence on its inclination and rotation in most cases opposite to the direction of flow of the kiln atmosphere. The reducing agent may consist of virtually any solid carbonaceous energy carrier, from anthracite and coke breeze to lignite and brown coal.

Most solid carbonaceous reducing agents contain combustible volatile constituents, which in lignites and brown coals constitute a substantial part of the energy content. In the previous practice, a major part of these combustible volatile constituents is directly transferred from the heat-receiving surface of the charge into the gas space of the rotary kiln as the charge is heated up. Part of these constituents can be burnt in that gas space. For this purpose, air is supplied through shell tubes, which are spaced along the length of the kiln. In large kilns, this may result in an uncontrolled, high heat loading in the free kiln space so that the surface of the charge and the kiln wall may become overheated and covered with disturbing incrustations. In that practice, the energy content of the volatile constituents can be transferred to the charge only from the free kiln space. Because the moving surface of the charge has only a limited heat-absorbing capacity, the larger quantity of heat offered to the charge results in a retention of heat with degasification of coal present on the surface of the charge so that the quantity of solid reducing agent which is available for the subsequent removal of oxygen during the reducing step is decreased and the total energy requirement is increased because the carbon deficiency must be compensated by a feeding of fresh coal in a correspondingly larger quantity. It has been found that up to 20% of the carbon which has been fed can be lost virtually without utilization as a result of that undesired gasification.

The feeding of air through shell tubes into the free kiln space over the charge may be replaced in known manner by a blowing of gases into the rotary kiln through nozzle blocks which have outlet openings disposed in the inside surface of the refractory lining or slightly inwardly of said surface.

It is known from U.S. Pat. No. 3,182,980 to blow hydrocarbons through nozzle blocks into the charge in the reduction zone and to blow oxidizing gases into the free space of the rotary kiln through nozzle blocks spaced along the rotary kiln. The same concept has been described in Opened German Pat. No. 2,146,133, which states that the temperature at the beginning of the reduction zone is at least about 975° C.

From German Auslegeschrift No. 10 32 550 it is known to blow air or reducing gases into the charge when the latter has been heated to the reduction temperature of 600° to 1000° C.

From German Auslegeschrift No. 22 39 605 it is known to blow air by means of nozzle blocks into the charge and the free kiln space of a rotary kiln which is charged with preheated pellets.

In connection with all these processes it has not been stated that measures are adopted in view of the problems related to the heating of the charge in a rotary kiln.

It is known from German Offenlegungsschrift No. 22 41 168 to blow oxygen-containing gases from the discharge end of the rotary kiln at a high velocity of flow approximately parallel to the longitudinal axis of the kiln so that shell tubes need no longer be used. As an additional measure, part of the oxygen-containing gas which is required may be blown through nozzle blocks into the charge and/or the free gas space in a portion which extends from the charging end over up to about one-fourth of the length of the rotary kiln. This practice enables a shortening of the heating-up zone because the oxygen supply is effectively distributed and affords advantages particularly in smaller rotary kilns, in which the conditions of flow are improved when the shell tubes are eliminated. In large rotary kilns, shell tubes exert a much smaller influence on the conditions of flow in the kiln and the long blowing distance and aerodynamical conditions in such kilns impose limitations regarding the blowing of air from the discharge end. A relatively large number of nozzle blocks would be required for a blowing of oxygen-containing gases through nozzle blocks in the heating-up zone and would result in a weaker kiln structure and involve a high expenditure for the distribution of the gas. Otherwise, there is a danger of high dust losses caused by high velocities of the blown gases, and a danger of cold-blown spots and hot spots. The blowing of oxygen-containing gases through nozzle blocks into the gas space results in a less effective mixing of the gases, continual changes of temperature, an uncontrolled combustion and an overheating of the refractory lining.

The object underlying the invention disclosed in copending application Ser. No. 898,256 is to accelerate the heating of the charge in the rotary kiln in which solid carbonaceous reducing agents are used, to utilize the combustible volatile constituents in the kiln to a high degree, and to provide for optimum conditions in the kiln.

In accordance with Ser. No. 898,256 that object is accomplished in that oxygen-containing gases are blown through nozzle blocks at controlled rates into the charge disposed over nozzle blocks in the heating-up zone in that region thereof which begins with the appearance of ignitable particles of the solid reducing agents and terminates before the reducing zone, and oxygen-containing gases are blown at a controlled rate through shell tubes into the free kiln space at least in that region.

Ignitable particles occur first in the lower portion of the rolling surface of the charge. As the individual particles roll down on the surface of the rolling bed, the particles are heated up by the hot kiln gases and reach the ignition temperature shortly before entering the interior of the rolling bed at a certain distance from the charging end. This is the first point at which oxygen-containing gases are blown into the charge through nozzle blocks. As a result, the ignitable reducing agent particles which have been ignited are not cooled below the ignition temperature as they enter the colder interior of the rolling bed but continue to burn within the rolling bed. The combustion then taking place within the charge results in a release of additional volatile combustile constituents and a phenomenon similar to a chain reaction soon spreads throughout the cross-section of the charge. As a result, the heat content of the volatile combustible constituents can now be fully utilized for the heating of the charge and the heat exchange surface which is available for the heat transfer is much increased. Additional nozzle blocks spaced about 2.5 to 3.5 meters apart are provided in that region of the heating-up zone. With that spacing it is usually possible to blow sufficient oxygen into the bed without weakening the kiln structure. The radial nozzle blocks are spaced around the periphery of the kiln at each blowing station. The peripheral spacing usually amounts also to 2.5 to 3.5 meters. Control mechanisms are provided which ensure that oxygen-containing gases are fed only to those nozzle blocks of each annular series which are disposed under the charge. The oxygen-containing gas consists usually of air. The term "nozzle blocks" describes gas feeders which extend through the kiln wall and the refractory lining of the rotary kiln and have outlet openings disposed in the inside surface of the refractory or slightly inwardly or outwardly of said surface. The nozzle blocks may consist of ceramic or metallic materials. Shell tubes are used to feed oxygen-containing gases into the free kiln space in the heating-up and reduction zones. The shell tubes extend radially and are spaced along the rotary kiln. Their outlet openings are disposed approximately at the center of the cross-section of the kiln and are parallel to the longitudinal axis of the kiln. In this arrangement, the outlet openings are not covered by the charge so that one shell tube is sufficient at each blowing station.

Combustible substances, such as coke oven gas, refinery gas, natural gas or petroleum may be added to the oxygen-containing gases blown through the nozzle blocks. This measure may be adopted to effect an earlier or faster ignition. The combustible substances which are added may partly perform the function of the combustible volatile constituents of the solid reducing agent if the latter has a low content of such constituents.

It is also possible to charge the kiln with oil-containing rolling mill scale and to utilize the oil content of such scale as a combustible volatile constituent to heat the charge.

In a preferred embodiment, the said region of the heating-up zone begins where the reducing agent has a temperature of about 300° C. and terminates where the charge has a temperature of 800° to 950° C. The lower temperature of the reducing agent is measured in the lower portion of the surface of the rolling bed formed by the charge, shortly before the particles enter the interior of the rolling bed, as has been described herein-before. The upper temperature is the average temperature of the entire rolling bed formed by the charge, i.e., a temperature which is assumed by the rolling bed after a substantial equilization of temperature. The selection of that temperature range ensures particularly that the charge is not cold-blown at temperatures below the lower limit (300° C.) and the expulsion of the volatile constituents has been substantially completed at the upper temperature limit (800° to 950° C.).

According to a preferred feature, 40 to 70% of all oxygen fed into the rotary kiln are blown into said region of the heating-up zone. This results in a particularly good heating-up rate.

According to a preferred feature, 10 to 60% of the oxygen which is blown into said region of the heating-up zone are blown through the nozzle blocks into the charge and the remainder is blown through the shell tubes into the free kiln space. This results in a fast heating and a substantial combustion of the combustible gaseous constituents in the free kiln space.

According to a preferred feature, the oxygen-containing gases blown through nozzle blocks into the first portion of said region of the heating-up zone have an oxygen content which is in stoichiometric proportion to the combustible volatile constituents which are formed there and are to be burnt, and the oxygen content of the oxygen-containing gases is decreased to a sub-stoichiometric proportion along the said region of the heating-up zone as far as to the end thereof. With the aid of temperature measurement, the rate of decrease is controlled in such a manner that no solid carbon is burnt directly. The beginning of said region of the heating-up zone is the beginning as seen from the charging end. That portion of said region of the heating-up zone in which oxygen is blown through the nozzle blocks in a proportion which is at most stoichiometric is the portion in which the bed has an average temperature of 600° to 700° C. This enables a substantial utilization of the volatile constituents for the combustion substantially without a direct combustion of solid carbon.

The advantages afforded by that process reside in that the heating-up zone of the rotary kiln is substantially shortened so that either the throughput rate of a given kiln is increased or a given throughput rate can be achieved with a smaller kiln. Besides, the difference between the gas temperature and the bed temperature is minimized and the exhaust gas temperature is minimized too. The lower heat loading results in a decrease of the risk of incrustation and in a higher durability of the refractory lining. The total energy consumption is greatly decreased because the heat content of the volatile combustible constituents of the reducing agent is utilized in a high degree, the gas temperature in the free kiln space and the exhaust gas temperature are decreased, and the direct gasification of carbon on the bed surface is decreased because no heat is retained here, as could otherwise occur.

The direct reduction process will be the more economical the lower is the cost of the solid reducing agent and fuel which is used.

It has already been proposed to effect a partial degasification and dry distillation of waste rubber, particularly automobile tires, in a separate combustion plant at temperatures between 500° and 1400° C. with substoichiometric quantities of air, and to effect a complete combustion of the resulting combustible gases with air in a burner. The burner flame is used to heat a rotary kiln and the resulting coke is used in the rotary kiln as a reducing agent for the direct reduction of iron oxides to produce sponge iron (German Offenlegungsschrift No. 22 41 435). That process involves considerable heat losses and owing to the separation of the combustion plant and the rotary kiln involves a considerable expenditure.

In a process of burning cement clinker in a rotary kiln it is known to supply most of the required heat by burning a base fuel and rubber products, preferably used tires, in a quantity of up to 40% of the quantity of the base fuel. In that process, deleterious influences cannot be prevented if the quantity of added rubber products exceeds 20 to 25% of the amount of base fuel. The rubber products are supplied to the sintering stage and preferably from the burner end of the rotary kiln in the core range of the flame zone in a region which in a rotary kiln having a length of 70 meters is spaced about 30 meters from the discharge end of the kiln and in which the flame core has a temperature of 1800° to 2000° C. and the charge bed has a temperature of about 1450° C. That process cannot be used for a direct reduction process, in which much lower temperatures must be used. In addition, a theoretical transfer without deleterious influences would be possible only if the addition did not exceed 25%.

It is an object of the invention to effect an economical direct reduction of iron oxide-containing material in a rotary kiln in conjunction with the use of waste rubber.

In accordance with the invention this object is accomplished in that the solid carbonaceous reducing agent used in the process according to copending application Ser. No. 898,256 consists at least in part of disintegrated waste rubber. The waste rubber consists preferably of properly disintegrated automobile tires. The waste rubber is fed to the rotary kiln at its charging end together with the remaining charge. The preferred features described in copending application Ser. No. 898,256 now U.S. Pat. No. 4,179,280 may be used and will afford the described advantages also where waste rubber is employed. The sulfur which is contained in the waste rubber that is supplied is combined by an addition of desulfurizing agents which are effective in a solid state under reducing conditions. These agents include lime, limestone, burnt dolomite and raw dolomite. The temperatures and the combustion relations in the specific region of the heating-up zone are controlled by the control of the rates at which oxygen is blown through the nozzle blocks and shell tubes and in the reduction zone and possibly in the first part of the heating-up zone by a controlled supply through shell tubes or shell burners. Up to 100% of the reducing agent may consist of waste rubber. Alternatively, other solid carbonaceous reducing agents may be added in any desired proportion. If such other solid carbonaceous reducing agents are added in relatively large quantities, they consist suitably at least in part of substances having a high content of volatile combustible constituents. If such other solid carbonaceous reducing agents are added in small quantities, it may be desirable to use reducing agents which have a low content of volatile constituents and react slowly, such as coke breeze. Such reducing agents then constitute surplus carbon serving as a safety reserve in the reduction zone. Surplus carbon which has been separated from the discharged material can be recycled.

According to a preferred feature of the invention, the waste rubber which is fed has a particle size below 30 mm. This results in a thorough mixing of the waste rubber with the remaining charge and an effective utilization of the volatile combustible constituents in the heating-up zone when the ignition temperature has been reached.

According to a preferred feature, more than 80% of the solid carbonaceous reducing agent consists of waste rubber. In that case the reducing agent and fuel used in the process consists virtually only of waste material.

According to a preferred embodiment, the iron oxide-containing material contains volatilizable non-ferrous metals or volatilizable non-ferrous metal compounds. The zinc which is contained in the waste rubber up to about 2% is volatilized on the rotary kiln and discharged in the exhaust gas and is collected as dust when the exhaust gas is cleaned. Any volatilizable non-ferrous metals or volatilizable non-ferrous metal compounds contained in the iron oxide-containing material will also be recovered in the collected dusts so that the latter can be processed with higher economy owing to their higher non-ferrous metal content.

The advantages afforded by the invention reside in that a direct reduction can be effected in an economical and simple manner with waste rubber as inexpensive reducing agent and fuel whereas an additional process step is not required. Besides, the problems and costs related to a dump for waste rubber or to another processing of waste rubber can be avoided without need for an additional expenditure. The zinc contained in automobile tires can be recovered for utilization, and the iron content is included in the sponge iron so that the processing of the water rubber does not result in waste products. The advantages afforded by the process according to copending application Ser. No. 898,256 now U.S. Pat. No. 4,179,820 can be fully preserved.

EXAMPLE 1

A rotary kiln which had an inside diameter of 0.8 m and a length of 12 m was charged with brown coal having a moisture content of 20% together with ore pellets containing 67% Fe. On a dry basis, the coal had the following analysis: 44% C fixed, 50% volatile constituents and 6% ash. The length of the heating-up zone was about 25% of the length of the kiln. A 50% share of the total air which was supplied into the kiln was supplied in the heating-up zone, and 50% of said share were supplied through nozzle blocks into the rolling bed material and 50% of said share through air pipes into the free kiln space. The following operating conditions were obtained:

| | |
|---|---|
| pellet-charging rate | 650 kg/h |
| $C_{fixed}$/Fe ratio | 0,30 |
| metallization | 93% |
| waste gas temperature | 800° C. |

EXAMPLE 2

After obtaining steady operating conditions according to example 1, the brown coal was replaced step by step up to 100% by disintegrated waste tire material with a grain size of 20 to 30 millimeter.

The operating results remained practically the same. The Zn-content of the waste tire material was practically completely volatilized and could be separated from the kiln waste gas in form of a flue dust suitable for feeding into non-ferrous smelters. The sulfur content of the waste tire material was bound by addition of fine grained dolomite. The sponge iron contained only 0.03% sulfur and was suitable for feed material for steel production. The steel content of the waste tire material went also into the discharge material and could be recovered. The waste tire material had the following composition without the steel material:

| | |
|---|---|
| C fixed | 32,5% |
| valatile constituents | 64,6% |
| ash | 2,9% |
| The sulfur content was | 1,7% and the |
| Zink content | 1,3% |

We claim:

1. In a process for directly reducing iron oxide-containing material to produce sponge iron in a rotary kiln by treatment with solid carbonaceous reducing agent having a high content of volatile combustile components, in which the charge is moved through the rotary kiln opposite to the direction of flow of the kiln atmosphere, oxygen-containing gases are blown at controlled rates through nozzle blocks into the charge disposed over nozzle blocks in the heating-up zone in that region thereof which begins with the occurrence of ignitable particles of the solid reducing agent and terminates before the reducing zone, and oxygen-containing gases are blown in at controlled rates through shell tubes into the free kiln space at least in that region, the improvement wherein at least a portion of the solid carbonaceous reducing agent comprises disintegrated waste rubber.

2. A process according to claim 1 wherein the waste rubber has a particle size below 30 mm.

3. A process according to claim 1 wherein more than 80% of the solid carbonaceous reducing agent comprises waste rubber.

4. A process according to claim 1 wherein the iron oxide-containing material contains volatilizable non-ferrous metals or volatilizable non-ferrous metal compounds.

5. A process according to claim 1 wherein at least a portion of said waste rubber is introduced into a rolling bed of iron oxide-containing material through nozzle blocks disposed beneath said bed.

6. A process according to claim 1 wherein 100 percent of the solid carbonaceous reducing agent is waste rubber.

* * * * *